United States Patent [19]

Koike et al.

[11] 4,400,952

[45] Aug. 30, 1983

[54] STITCH TRANSFER DEVICE FOR A KNITTING MACHINE

[75] Inventors: Mitsuhito Koike; Atsushi Satoh, both of Kodaira, Japan

[73] Assignee: Silver Seiko Ltd., Tokyo, Japan

[21] Appl. No.: 329,139

[22] Filed: Dec. 9, 1981

[30] Foreign Application Priority Data

Dec. 16, 1980 [JP] Japan ..... 55-176529

[51] Int. Cl.[3] ..... D04B 7/00

[52] U.S. Cl. ..... 66/60 H; 66/116; 66/64; 66/70

[58] Field of Search ..... 66/60 H, 73, 60, 67, 66/7, ,72, 64, 116

[56] References Cited

U.S. PATENT DOCUMENTS 3,609,996 10/1971 Irmscher et al. ..... 66/76
4,238,937 12/1980 Nakaoka ..... 66/60 H
4,358,938 11/1982 Sasaki ..... 66/60 H X

FOREIGN PATENT DOCUMENTS 687091 12/1939 Fed. Rep. of Germany .
1043568 11/1958 Fed. Rep. of Germany .
908976 4/1946 France .
2085036 4/1982 United Kingdom ..... 66/60 H

*Primary Examiner*—Ronald Feldbaum
*Attorney, Agent, or Firm*—Lane, Aitken and Kananen

[57] ABSTRACT

A stitch transfer device for a V-bed knitting machine, for transferring stitches from needles 4 in a first needle bed to needles 2 in a second needle bed comprises a carrier 5 slidably mounted on the second needle bed, a stitch transfer element 11 being mounted on carrier 5 for vertical and back and forth reciprocating movement. By means of interconnected cams, operable by rotation of a handle 21 on carrier 5 and cam follower and lever mechanisms cooperating with said cams, the stitch transfer device is moved up and down and back and forth, and the respective needles 2 of the second bed moved back and forth longitudinally, in a predetermined sequence which produces, reliably, one desired stitch transfer per revolution of the handle 10.

The device affords high reliability of stitch transfer in a mechanical fashion, with a substantial reduction in time and labor, in operation, as compared with stitch transfer by means of hand held tools.

13 Claims, 14 Drawing Figures

STITCH TRANSFER DEVICE FOR A KNITTING MACHINE

BACKGROUND OF THE INVENTION

This invention relates to a stitch transfer device for use with a knitting machine, more particularly for a V-bed knitting machine, and more specifically to a device for transferring stitches of a yarn being knitted from needles of one needle bed to needles of the other needle bed of such a machine.

In producing a knitted article such as a sweater, a skirt, a vest and so on, on a V-bed knitting machine, especially a hand-operated machine for domestic use, it is occasionally required to transfer stitches from knitting needles in one needle bed to knitting needles in the other needle bed. Conventionally, stitches are manually transferred one by one using a specific device such as that known as a transfer tool which includes a rigid wire-like element secured to a handle and having an eye formed adjacent its free end. In operation, the hooked end of a first needle in a first needle bed is first inserted into the eye of the tool, then the tool is pivoted about the hooked needle end into alignment with the needle and is moved axially to push the needle into the first needle bed whereupon a stitch is transferred from the needle onto the tool. The tool is then disengaged from the needle and is now coupled to a second needle in a second needle bed with its hooked end inserted in the eye thereof whereafter the stitch is slidingly displaced onto the hook of the second needle, for example, by pivoting the tool around the hook of the second needle. The tool is then removed from the second needle with the stitch left on the second needle, thereby completing the transfer of the stitch. This sequence of such manual operations is repeated as many times as there are stitches to be transferred. In knitting some articles, a plurality of rows of stitches may have to be transferred. Such manual operations are very troublesome to an operator and often require skill.

A stitch transfer carriage which is provided specifically for transferring stitches may also be used in addition to a knitting carriage. The transfer carriage is manually slid on the needle bed in an uninterrupted manner whereby stitches on all or selected knitting needles in one needle bed are transferred to corresponding knitting needles in the other needle bed. Thus, the transfer carriage advantageously provides for very rapid transfer of stitches. Such a transfer carriage, however, is disadvantageous in that stitches cannot always be transferred perfectly: sometimes, stitches may drop from the knitting needles, producing laddering, which, of course, is quite unacceptable in a knitted fabric, although a skilled operator may be able to remedy these defects. In order to ensure perfect transfer of stitches, some knitting machines for industrial use employ specially designed knitting needles with stitch transfer functions. Such specially designed needles, however, significantly raise the production cost of knitting machines.

SUMMARY OF THE INVENTION

Accordingly, it is an object of the present invention, in one aspect, to provide a stitch transfer device for a V-bed knitting machine which can be produced at a low cost and can reliably and relatively rapidly transfer stitches from needles of one needle bed to needles of the other needle bed of a V-bed knitting machine in an easy simplified operation without the necessity of employing specially designed knitting needles.

According to one aspect of the invention, there is provided a stitch transfer device for transferring stitches from knitting needles in a first needle bed of a V-bed knitting machine, to knitting needles in a second needle bed of said machine, said first and second needle beds being disposed such that the needles in said first needle bed are opposed to the needles in said second needle bed, and the needles in each needle bed are disposed in side by side relationship to one another, each said needle having a respective latch pivotable to open and close a hook thereof and being mounted in the associated needle bed for longitudinal back and forth movement, said stitch transfer device comprising: a carrier slidably mounted on said second needle bed; a stitch transfer element for transferring a stitch from a first particular needle in said first needle bed to a second particular needle in said second needle bed; first means for moving said transfer element in an axial direction parallel with the needles in said first needle bed; second means for moving said transfer element in a lateral direction parallel with the needles in said second needle bed; advancing means for advancing the second needles in said second needle bed; feeding means for feeding said carrier one needle space at a time along said second needle bed; and a single cyclically operable actuator mechanism for sequentially actuating said first and second means as well as said advancing means and said feeding means whereby by operation of said actuator mechanism said carrier can first be fed one needle space along said second needle bed, said stitch transfer element can then be moved from its initial position in a lateral direction into a position in the plane of the needles in said first needle bed and into engagement with the first particular needle and then in an axial direction to push said first needle into said second needle bed whereupon the stitch on the first needle is transferred onto said element, and said stitch transfer element can again be moved in the opposite axial direction out of engagement with said first needle, the corresponding second needle in said second needle bed then advanced to project its hook through the stitch on said stitch transfer element to receive the stitch from said element, and said element finally moved in the opposite lateral direction to its initial position, thereby completing transfer of the stitch from the first to the second needle.

It is an object of the invention, in another aspect, to provide a stitch transfer element for a stitch transfer device for a V-bed knitting machine.

According to another aspect of the invention, there is provided a stitch transfer element for use with a stitch transfer device for transferring stitches from knitting needles in a first needle bed to knitting needles in a second needle bed of a V-bed knitting machine, comprising a stem having one end for connection to a said stitch transfer device, and a pair of spring fingers extending along opposite sides of said stem, each of said spring fingers having one end thereof secured to an intermediate portion of said stem, the other ends of said spring fingers extending beyond the other end of said stem and being bent and resiliently biased towards each other to resiliently engage with each other via their extremities, said the other ends of said spring fingers and said the other end of said stem cooperatively defining an eye which, in use, can receive therein the hook of a first needle in a first needle bed and through which a second needle in a said second needle bed can project in a direction perpendicular to said first needle.

BRIEF DESCRIPTION OF THE DRAWINGS

Embodiments of the invention are described below by way of example, with reference to the accompanying drawings, in which.

DESCRIPTION OF THE PREFERRED EMBODIMENT

Figure 1:
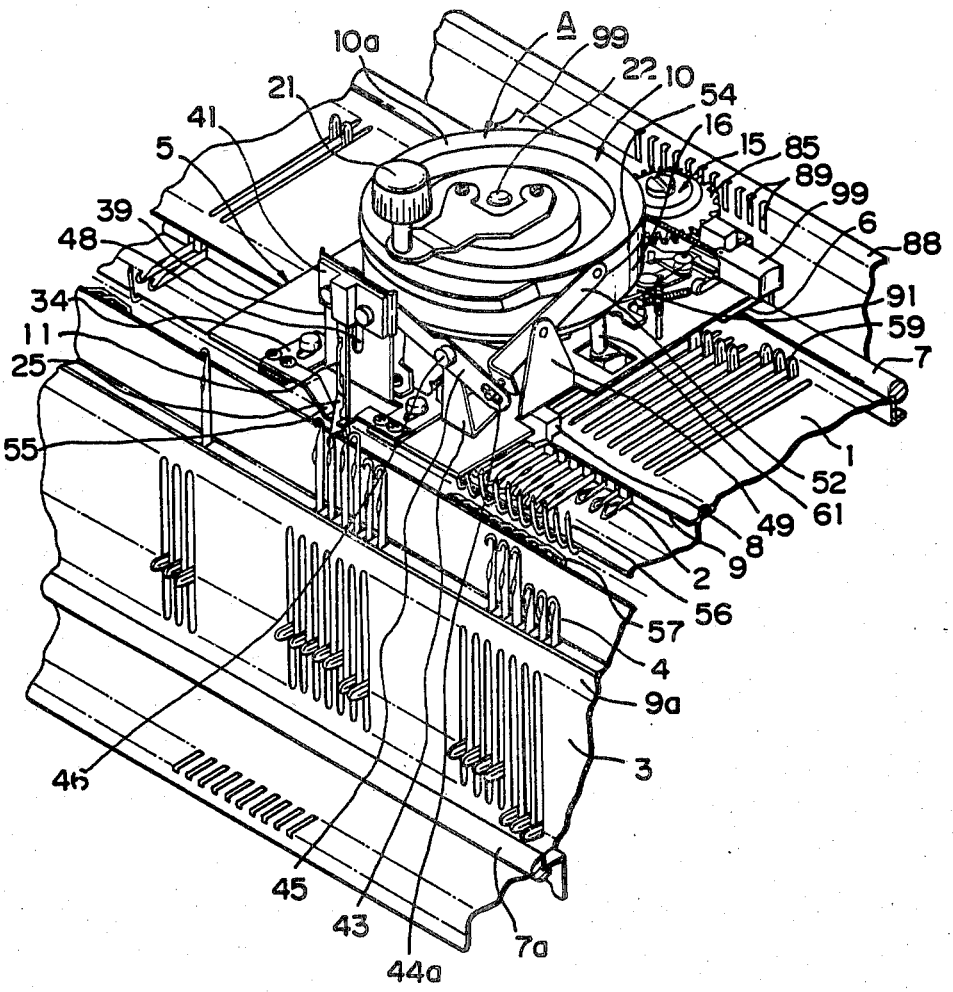
FIG. 1 is a perspective view showing a stitch transfer device embodying the present invention mounted on a V-bed knitting machine, with a cover of the deive removed to show the internal organisation of the device.

A preferred embodiment of a stitch transfer device in accordance with the present invention is shown in FIG. 1 and is generally referred to by the reference character A. The stitch transfer device A is shown mounted on a knitting machine of a type intended for domestic use. The knitting machine includes a rear, flat, longitudinally extending needle bed 1 to which a front needle bed 3 of the same construction is removably attached with suitable fastening devices (not shown) thereby to constitute a so-called V-bed knitting machine. Each needle bed 1, 3 contains a large number of latch needles 2, 4 respectively, mounted therein in a spaced, side by side relationship to one another for back and forth movement therein. Each needle bed 1, 3 further has fixed sinker elements 56, 57, respectively, appropriately disposed for co-operation with those needles 2, 4, respectively. The rear and front needle beds 1, 3 are disposed so that their sinker elements 56, 57 are opposed to each other while their needles 2, 4 are also opposed to each other. The latch needles 2, 4 (see e.g. FIGS. 6, 10 and 12) are of conventional design and include a hook 68 or 93 (FIG. 10), a swinging or pivoting latch 95, (FIG. 12) and a butt 59 (FIG. 6) which extends from the plane of the needle bed 1, 3 and which is adapted to contact cam(s) on a conventional knitting carriage (not shown) to effect the various needle movements to provide a knitted fabric (not shown) from a supply of yarn (not shown).

As shown in FIG. 1, the stitch transfer device A of the present invention includes a carrier 5 that is mounted on the needle bed 1 for movement in the longitudinal direction along the length of the bed (that is, substantially from the right to the left as viewed in FIG. 1). The carrier 5 has a substantially rectangular shape and has a slider 6 secured thereto by which means the carrier 5 is mounted at its rear edge for sliding movement on a guide bar or rail 7 located rearwardly of the needle bed 1 and extending along the length of the bed. Another slider 8 is provided on the underside of the carrier 5 to engage and slide relative to the forward edge 9 of the needle bed 1. The front needle bed 3 also has a similar guide rail **7*a* and a similar needle bed edge 9*a* so that the stitch transfer device A can also be placed on and moved along the front needle bed 3**.

Figure 6:
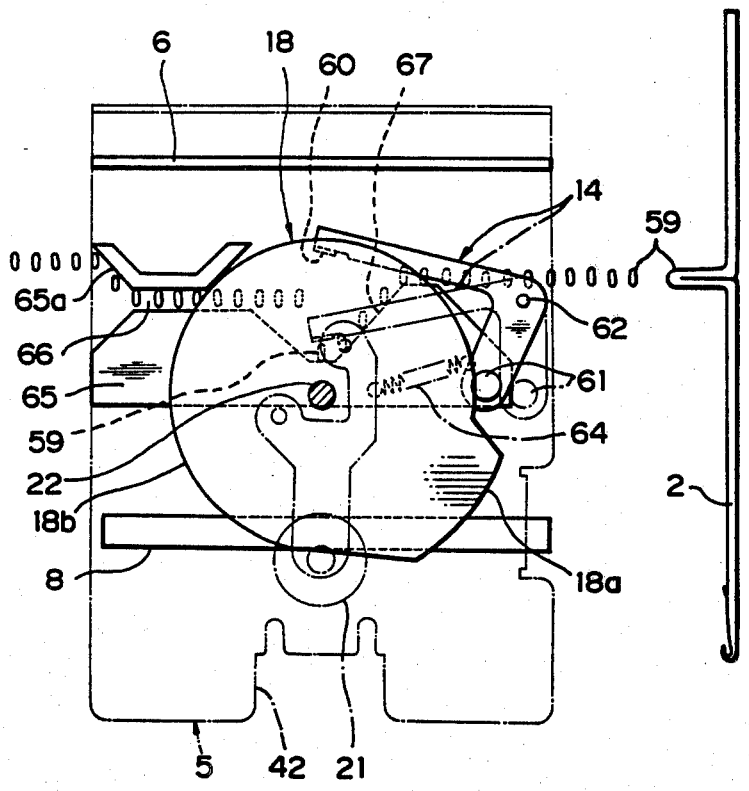
FIG. 6 is a partial plan view, in diagrammatic form, showing the operative relationship between a needle advancing member and an actuator cam therefor.

A track cam 65 (FIG. 3) is secured to the underside of the carrier 5 by suitable threaded fasteners (not shown) and includes a downwardly facing track or guideway 66 that is adapted to engage the upwardly extending butts 59 of the needles 2 as the carrier 5 moves along the guide rail 7. As the carrier 5 moves along the guide rail 7, the butts 59 of the needles 2 in their partially advanced intermediate position (as indicated by the two leftmost needles in FIG. 1) are advanced further by an advancing cam edge **65*a* of the track cam 65 and enter the guide way 66, as seen from FIG. 6. As the carrier 5 moves further, the butts 59 are thereafter retracted by a retracting cam edge 67 of the track cam 65 to the intermediate position, as also shown in FIG. 6**.

A multiple cam actuator mechanism, generally designated by the reference character 10, is centrally mounted on the upper side of the carrier 5 and is connected, through various cam follower mechanisms as described in detail below, to a stitch transfer element 11, a positioning member 12, a needle restraining member 13, a needle advancing member 14, and a carrier incrementing or feed mechanism 15.

Figure 4:
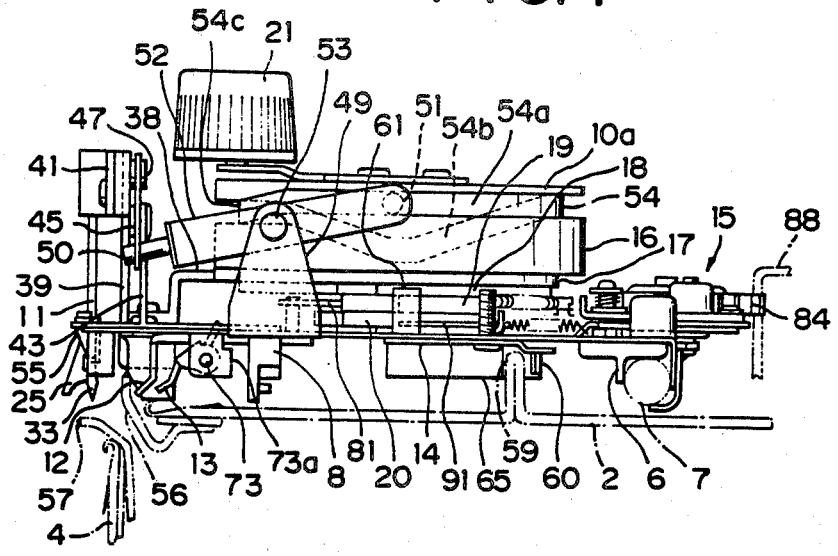
FIG. 4 is a side elevational view of the stitch transfer device of FIG. 1 as viewed from the right in FIG. 1.

As shown in FIGS. 1 and 4, the actuator mechanism 10 includes a cam block **10*a* having five actuator cams 16, 17, 18, 19 and 20 mounted in a stacked or overlapping relationship. The cams are rotatably mounted on a shaft 22 that extends upwardly from the carrier 5 and are manually rotatable about the shaft 22 by a handle 21. The cams are so mounted relative to one another and to their respective cam follower mechanisms that one complete rotation of the cam block 10*a* in the clockwise direction as viewed in FIGS. 1 and 2** will cause transfer of one stitch of the knitted fabric as hereinafter described in detail. The concept of manipulating stitches of a knitted fabric respectively one by one by means of a device including a single manually operable actuator mechanism is disclosed in a patent application entitled "Fabric Manipulating Device for Manipulating the Loops of a Knitted Fabric", Ser. No. 054,944 filed on July 5, 1979 in the name of Mitsuo Nakaoka and assigned to the same assignee as the present application, now U.S. Pat. No. 4,238,937. Some of the mechanisms incorporated in the stitch transfer device described with reference to the drawings of the present application are similar in design to corresponding mechanisms of the fabric manipulating device disclosed in the above-mentioned patent application.

Figure 8:
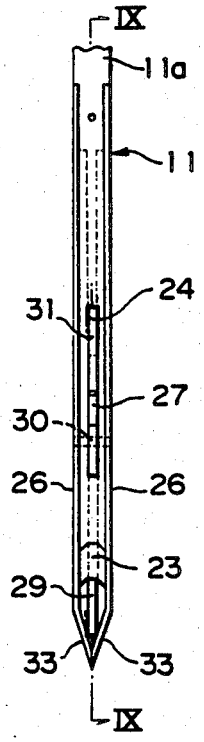
FIG. 8 is an enlarged detailed partial rear elevational view of a stitch transfer element forming part of the device of FIGS. 1 to 7.
Figure 9:
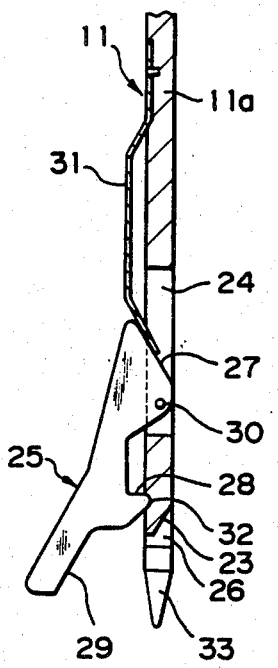
FIG. 9 is a vertical sectional view substantially taken along line IX—IX of FIG. 8.

Referring now to FIGS. 8 and 9, the stitch transfer element 11 includes a stem or shank **11*a*** of a rectangular cross-section which has a forwardly inclined needle guide face 23 formed at a lower extremity thereof. A vertical slit 24 is formed in the stem 11*a* spaced from the lower end thereof and extends through the stem 11*a* between its front and rear faces.

A stitch holding member 25 in the from of a shaped strip of thin rigid sheet metal is pivotally supported at an upper substantially triangular mounting portion 27 thereof in the slit 24 of the stem 11*a* by means of a pin 30 for rocking movement relative to the stem 11*a*. The stitch holding member 25 extends downwardly forwards from the stem 11*a* and has at a lower end thereof a rearwardly directed substantially triangular projection 28. The stitch holding member 25 further has an inclined lower extension which provides a needle engaging portion or edge 29 on the lower rear side thereof. A lower end of spring 31 which has its upper end secured to the front side of the stem 11*a* above the slit 24 abuts against the rear side of the upper end of the mounting portion 27 to bias the stitch holding member 25 in a counterclockwise direction about the pin 30 as viewed in FIG. 9. Thus, the stitch holding member 25 is biased towards, and normally held in, a position in which the rear tip end of the projection 28 thereof is fitted in a recess 32 which is formed in the front of the stem 11*a*. The stitch holding member 25 is designed so that the stitch holding member 25 and the stem 11*a* cooperatively define therebetween a space through which a yarn or thread of a stitch can extend when the stitch holding member 25 is in its normal position (as shown in phantom in FIG. 12).

Stitch guide springs 26 in the from on narrow strips of flexible resilient material, and being effectively leaf springs, are secured at upper ends thereof to opposite sides of the stem 11*a* and extend along the opposite sides of the stem 11*a* beyond the lower extremity of the stem 11*a*. The lower ends 33 of inverted triangular shape of the respective springs 26 are bent inwards or toward each other with their extremities resiliently pressed against each other in V-fashion. These lower end portions 33 are located below the needle guide surface 23 of the stem 11*a* and rearward of the needle engaging portion 29 of the stitch holding member 25.

Referring to FIGS. 1, 2, 4 and 5, the stitch transfer element 11 is mounted for up and down and back and forth movement, i.e. for axial movement along its length, and for lateral movement parallel with the needles 2. Thus the element 11 is mounted for vertical movement on a slide plate 34 which is itself mounted for horizontal movement. The slide plate 34, has, as viewed in plan in FIG. 5, substantially the shape of a reversed or mirror-image "L" and is mounted centrally on the front of the carrier 5 for back and forth movement with three elongated slots 35 therein receiving respective pins 36 which are secured on the carrier 5. The slide plate 34 is biased rearward by a pair of tension springs 37 and is linked with the actuator cams 16 and 17. An upright wall member is secured to the slide plate 34 and has at the top thereof a rearwardly extending cam follower projection 38 of a substantially triangular shape in plan view which is normally pressed against the actuator cam 17.

The slide plate 34 includes at a mid portion thereof an integral upright support plate 39 of a rectangular shape and has a laterally extending rectangular excess 40 formed therein forwardly of the support plate 39. A mounting plate 41 is mounted vertically slidably along the front side of the support plate 39 and securely supports the stitch transfer element 11 at the top end thereof such that the stitch transfer element 11 extends vertically downwardly through the recess 40 in the slide plate 34.

Figure 2:
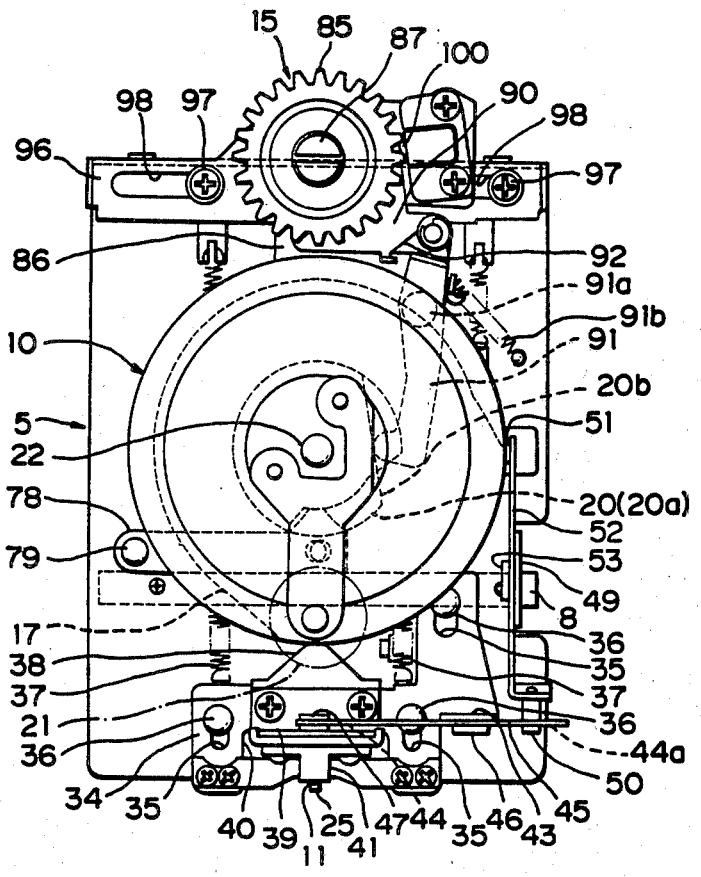
FIG. 2 is a plan view from above of the device of FIG. 1.

On the right hand side of plate 34, as viewed in FIG. 2, a support wall 43 integral with the plate 34 and formed by an upwardly bent, vertical portion of the plate, supports a lever 45 at a position intermediate the ends of the lever, for pivotal motion about a pivot 46. The lever 45 has elongated slots 44 and 44*a* formed in opposite end portions thereof. A pin 47 is securely fixed on the rear side of the mounting plate 41, and extends through a vertical slot 48 in the support plate 39 and has its projecting end engaged in the slot 44 in the left-hand end portion of the lever 45.

Another support wall 49 upstanding from the right-hand end portion of the carrier 5 (as viewed in FIG. 1), and integral with carrier 5, supports a lever 52 at a position intermediate the ends of lever 52, for pivotal motion about a pivot 53 which is mounted on the support wall 49. The lever 52 has pins 50 and 51 mounted on opposite end portions thereof. The pin 50 at the front end is inserted into the slot 44 in the right-hand end portion of the lever 45, while the pin 51 at the rear end is engaged in an annular cam groove 54 which is formed in the circumference of the actuator cam 16.

Guide strips 55 are mounted at respective base ends thereof on opposing forward extensions of the slide plate 34 and extend symmetrically into the recess 40 so that the opposing inner ends of the strips 55 are disposed adjacent to respective ones of the opposite sides of the stitch transfer element 11. The strips 55 serve to guide the transfer element 11 for axial movement without inadvertent lateral motion.

Figure 5:
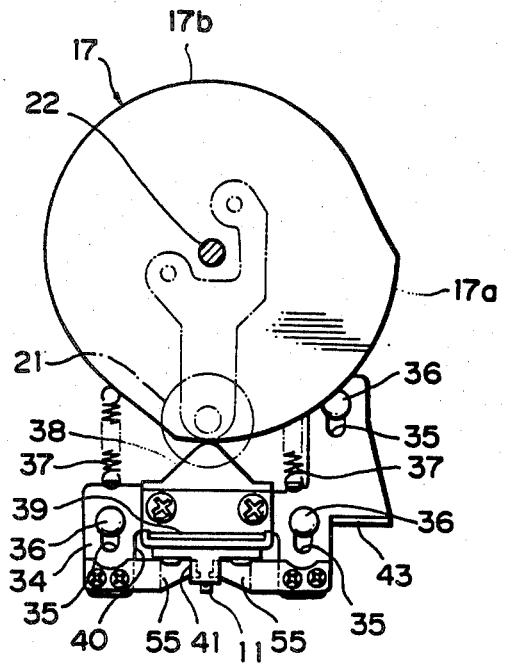
FIG. 5 is a partial plan view, in diagrammatic form, showing the operative relationship between a stitch transfer element and an actuator cam therefor.

The cam groove 54 of the actuator cam 16 has a high portion 54*a*, a low portion 54*b* and a middle portion 54*c* (FIG. 4), while the actuator cam 17 has an annular cam surface on the circumference thereof with a larger diameter portion 17*a* and a smaller diameter portion 17*b* (FIG. 5). Again, the actuator cam 17 is held in engagement with the cam follower projection 38 of the slide plate 34 by the springs 37.

Figure 10:
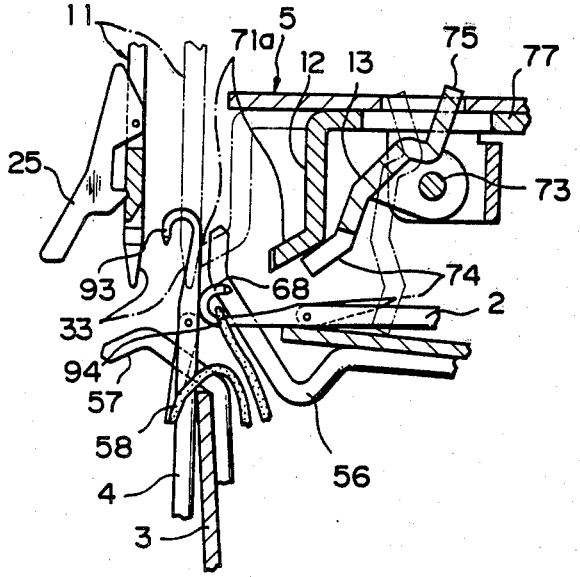
FIGS. 10 to 13 are enlarged partial sectional views, in diagrammatic form, illustrating different phases of the operation of transferring a stitch from a needle of the front needle bed to another needle of the rear needle bed.
Figure 11:
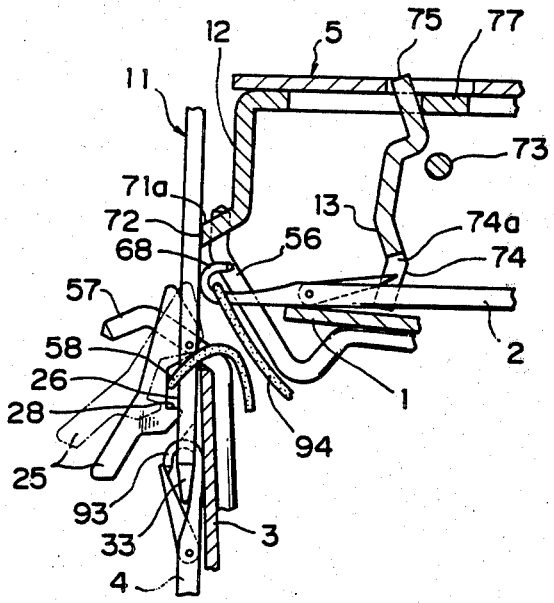
Figure 12:
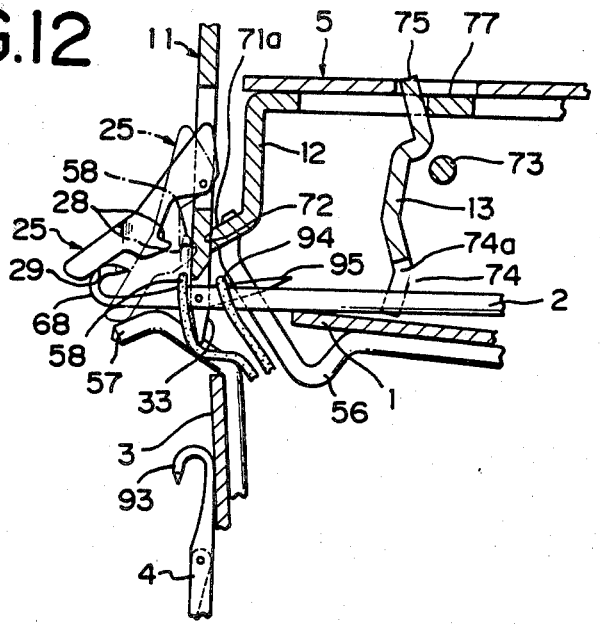
Figure 13:
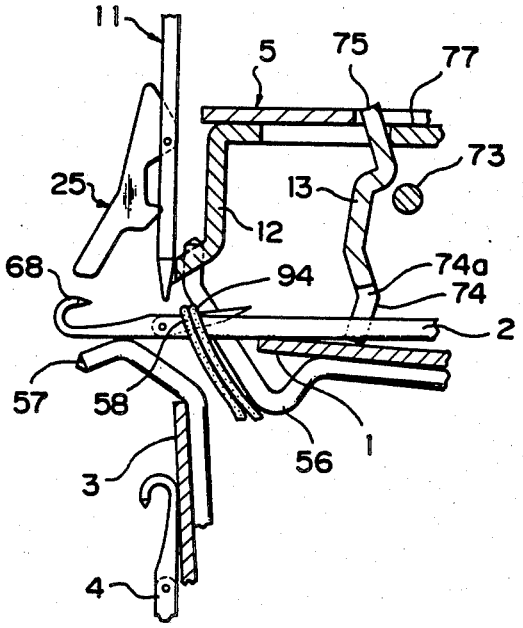

In the initial position of the cam block 10*a*, the pin 51 is positioned on the high portion 54*a* of the cam groove 54, and the lower end of the stitch transfer element 11, provided by the lower ends of the guide portions 33, is located in a position a little above the row of sinker elements 57 of the front needle bed 3 (FIGS. 4 and 10). If the actuator cam 16 is rotated in a clockwise direction from this initial position, the pin 51 rides from the high portion 54*a* to the low portion 54*b* of the cam groove 54, causing the lever 52 to pivot clockwise about its pivot 53 (FIG. 4). The lever 45 is thereby pivoted counterclockwise about its pivot 46 (FIG. 1) and hence the mounting plate 41 is lowered to displace the stitch transfer element 11 from its upper to its lower position (FIG. 11). Upon continued clockwise rotation of the actuator cam 16, the pin 51 rides from the low portion 54*b* to the middle portion 54*c* of the cam groove 54 to bring the stitch transfer element 11 to its middle position (FIG. 12). The stitch transfer element 11 is then returned to its upper position (FIG. 13) when the pin 51 subsequently rides from the middle portion 54*c* to the high portion 54*a* of the cam groove.

In the initial position of the cam block 10*a*, the cam follower portion 38 is engaged with the larger diameter portion 17*a* of the actuator cam 17, holding the stitch transfer element 11 in a position slightly forward of a plane including the latch needles 4 in the front needle bed 3 (the position indicated by solid line in FIG. 10).

As the actuator cam 17 is rotated clockwise, the cam follower portion 38 first rides from the larger diameter portion 17*a* to the smaller diameter portion 17*b* of the actuator cam 17, and the slide plate 34 is moved rearward under the influence of the springs 37 and 38, displacing the stitch transfer element 11 from its initial forward position to its rearward position (the position indicated by broken line in FIG. 10). The cam follower portion 38 then rides back to the larger diameter portion 17*a*, returning the stitch transfer element 11 to its forward position against the bias of the springs 37 and 38. In operation, the stitch transfer element 11 thus effects combined up-and-down and back-and-forth movements. Thus, the transfer element 11 is normally in an upper, forward position (shown in solid lines in FIG. 10) and is first displaced laterally rearward to an upper rear position (shown in phantom in FIG. 10). The element 11 is then axially moved downwards to a lower rear position (FIG. 11). After being displaced axially upward, in a subsequent step, to a middle rear position (FIG. 12), the stitch transfer element 11 in a yet further step, is moved axially upward to return to the upper rear position and is then laterally moved forward to the initial upper forward position.

Figure 3:
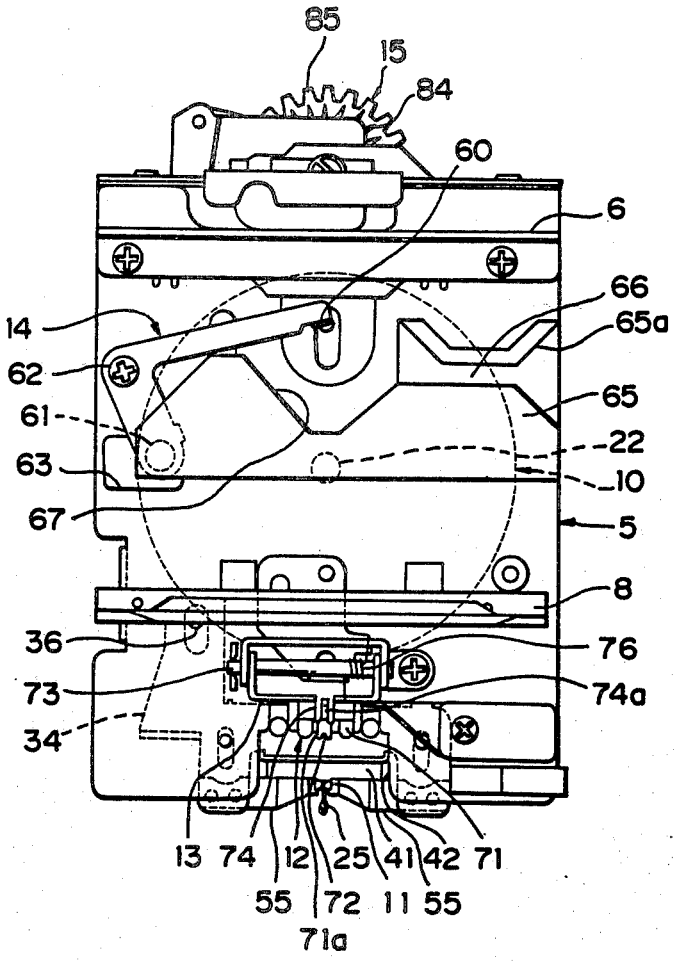
FIG. 3 is an underneath plan view of the device of FIG. 1.

Referring to FIGS. 3, 4 and 6, the needle advancing member 14 is in the form of a bellcrank lever formed from sheet or plate material and has a pusher cam 60 in the form of a bent lug formed at the free end of its longer arm for pushing a butt of a latch needle 2 forwardly. The needle advancing member 14 further has a pin 61 mounted on the upper surface of the free end of its shorter arm. The needle advancing member 14 is pivotally supported at the junction between its two arms on a pivot 62 which is mounted on a right-hand rear portion on the underside of the carrier 5. The pin 61 extends upwards through an aperture or window 63 formed in the carrier 5. The needle advancing member 14 is biased by a tension spring 64 to pivot about its pivot 62 in a clockwise direction as viewed in FIG. 6, so that the upwardly projecting end of the pin 61 is engaged with an annular cam surface of the actuator cam 18. The actuator cam 18 has a larger diameter portion 18*a* and a smaller diameter portion 18*b*, and in the initial position of the cam block 10*a*, the pin 61 is engaged with the smaller diameter portion 18*b* of the actuator cam 18, holding the pusher cam 60 in a rearward position at a rear centre portion of the carrier 5 behind the track cam 65. In the rearward position, the pusher cam 60 is positioned behind a butt 59 of a particular latch needle 2 which has been guided along the track 66 and advanced to an intermediate position and to which a stitch is to be transferred from an opposing front bed latch needle 4.

After rotation of the actuator cam 18 in the clockwise direction, through about three quarters of a turn, the pin 61 is brought into engagement with the larger diameter portion 18*a* so that the needle advancing member 14 is pivoted about its pivot 62 in a counterclockwise direction as viewed in FIG. 6 against the action of the tension spring 64, so that the pusher cam 60 abuts against and pushes forward the butt 59 to a position of maximum advancement.

As the actuator cam 18 is rotated further clockwise, the pin 61 passes again onto the smaller diameter portion 18*b* and the needle advancing member 14 is returned to its initial rear position under the action of the spring 64. The particular latch needle 2 which has been advanced as described is retracted later by a retracting cam edge 67 of the track cam 65 during subsequent incremental leftward movement of the carrier 5 on the needle bed 1.

Figure 7:
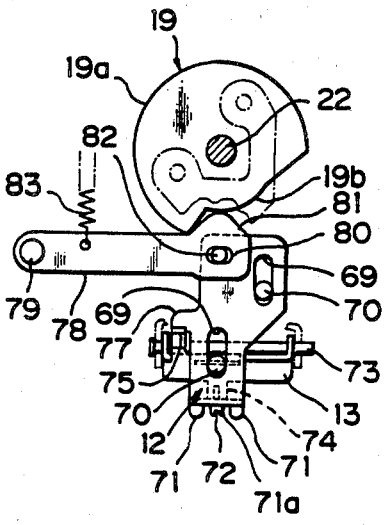
FIG. 7 is a partial plan view, in diagrammatic form, illustrating the operative relationship between a positioning member and a needle restraining member and actuator cam therefor.

Referring to FIGS. 3, 4 and 7, the positioning member 12 and needle restraining member 13 are mounted in a central position on the upper side of the carrier 5, at the front of the latter and are both operated by the actuator cam 19. More particularly, the positioning member 12 is formed by a plate of substantially L-shape in section and has a pair of slots 69 formed in its horizontally extending base portion which is disposed on the upper side of the carrier 5 for back and forth sliding movement thereon. Pins 70 secured to the carrier 5 extend through the respective slots 69 in the positioning member 12 to guide the positioning member 12 for such back and forth sliding movement. The positioning member 12 has, at a lower end of a forward, downwardly directed extension thereof, three downwardly and forwardly directed projections 71 and 71*a* adapted to be engaged between adjacent sinker elements 56 of the front needle bed 3. The centre projection 71*a* has formed at the forwardly directed end thereof a recess 72 for receiving and guiding the stitch transfer element 11.

The needle restraining member 13 is bent in U-shape in plan view and has its opposite arms pivotally supported beneath the positioning member 12 by a shaft 73 which is supported on a bracket 73*a* mounted on the underside of the carrier 5. The needle restraining member 13 has a pair of fingers 74 extending from the middle of a lower edge thereof to define therebetween a recess 74*a* to receive the stem of a latch needle 2. The needle restraining member 13 further has, at an upper left-hand edge thereof, (as viewed in FIG. 7), an extension 75 which extends upwardly through openings formed in the positioning member 12 and in the carrier 5. The needle restraining member 13 is biased by a spring 76 in a clockwise direction about the shaft 73 as viewed in FIG. 4 so that the upper extension 75 is normally pressed against a front edge of a projection 77 of the positioning member 12, which projection is disposed on the left of member 12 as viewed in FIG. 7.

A lever 78 has its left end (as viewed in FIG. 7) pivotally supported on the upper side of the carrier 5 by a pivot 79 and operatively links the positioning member 12 with the drive cam 19. The lever 78 has an elongated opening 80 formed adjacent its right end (as viewed in FIG. 7) and a projection 81 extending rearwardly from said right end.

A pin 82 is mounted on the upper side of the positioning member 12 and extends upwardly through an aperture or window (not shown) formed in the carrier 5 and through the opening 80 in the lever 78 to operatively couple the lever 78 to the positioning member 12. The lever is biased by a tension spring 83 to pivot about its pivot 79 in a counterclockwise direction as viewed in FIG. 7, so that the rearward projection 81 is pressed against the annular cam surface of the actuator cam 19. The actuator cam 19 has a larger diameter portion 19*a* and a smaller diameter portion 19*b* thereon.

In the initial position of the cam block 10*a*, the cam follower projection 81 of the lever 78 is engaged with the smaller diameter portion 19*b* of the actuator cam 19 so that the positioning member 12 is in its rearward inoperative position with its projections 71 and 71*a* spaced from the front bed sinker elements 56, and the needle restraining member 13 is in its rest position with the guide fingers 74 spaced from the rear bed latch needles 2 (FIG. 4).

During clockwise rotation of the actuator cam 19 (as viewed in FIG. 7), after the cam 19 has made about one quarter turn, the projection 81 rises onto the larger diameter portion 19*a* of the cam 19, while the lever 78 is pivoted clockwise (FIG. 7) against the action of the tension spring 83. As a result, the positioning member 12 is advanced to a forward operative position in which the projections 71 and 71*a* are engaged intimately between the adjacent front bed sinker elements 56 to thereby prevent undesired translatory rightward or leftward movement of the carrier 5 relative to the needle beds 1 and 3. Simultaneously, the centre projection 71*a* of the positioning member 12, via the recess 7*s* thereof abuts against the rear side of the stitch transfer element 11, as indicated in phantom in FIG. 10, to provide for appropriate guidance of the element 11 for its vertical movement. Meanwhile, upper extension 77 of the forwardly moving positioning member 12 engages the extension 75 of the restraining member to cause the member 13 to be pivoted about the shaft 73 counterclockwise as viewed in FIG. 10 to an operative position. In the operative position, the restraining member 13 receives, in the recess 74*a* between the lower guide fingers 74 thereof, the stem of a particular latch needle 2 so as to appropriately guide that particular needle 2 for its longitudinal movement and restrain the needle against lateral movement.

Referring now to FIGS. 2, 3 and 4, the carrier feed or incrementing mechanism 15 has a substantially similar structural design to that of the feed mechanism disclosed in the aforementioned patent application Ser. No. 054,944, filed on July 5, 1979, now U.S. Pat. No. 4,238,937, and includes a feed gear rotatably supported by a shaft 87 on a base plate 86 which is mounted at a rear end portion of the carrier 5, on the upper side thereof, for back and forth movement thereon. The feed gear 85 is normally meshed with a rack 89 which is provided on a rear riser wall 88 of the rear needle bed 1. The feed gear 85 has a ratchet gear 84 securely fixed to the underside thereof. A feed pawl 90 is pivotally mounted on a rear end of a lever 91 which in turn is pivotally supported on the base plate 86 by means of a pivot 91*a*. The feed pawl 90 is biased into engagement with the ratchet gear 84 by means of a torsion spring 92.

The actuator cam 20 (FIG. 2) is substantially oval in configuration and has thereon an annular cam surface consisting of a larger diameter portion 20*a* and a smaller diameter portion 20*b*. In the initial position of the cam block 10*a*, the forward end of the lever 91, which is biased clockwise (FIG. 2) about its pivot 91*a* by means of a tension spring 91*b*, is engaged with the smaller diameter portion 20*a* of the actuator cam 20. Now, if the actuator cam 20 makes about one sixth rotation clockwise (FIG. 2) from its initial position, the forward end of the lever 91 engages the larger diameter portion 20*a* and pivots about its pivot 91*a* in the counterclockwise direction as viewed in FIG. 2. Thereupon, the feed pawl 90 rotates the ratchet gear 84 and hence the feed gear 85 by one tooth pitch clockwise about the shaft 87, thereby feeding the carrier 5 by one needle pitch to the left on the needle bed 1.

The base plate 86 is movable under the control of a switch plate 96 within a limited range. The switch plate 96 is mounted for longitudinal movement on the carrier 5 by means of a pair of pins 97 which are mounted on the carrier 5 and extend through a pair of slots 98 formed in the switch plate 96. The switch plate 96 has a pair of buttons 99 (FIG. 1) mounted on opposite ends thereof, i.e. at the left and right end thereof as viewed in FIG. 1. The switch plate 96 is operatively connected to the feed mechanism 15 by a known mechanism (not shown), such as disclosed in the aforementioned patent application Ser. No. 054,944, now U.S. Pat. No. 4,238,937, such that movement of the switch plate 96 from its extreme left to its extreme right position retracts the feed gear from the rack 89 of the needle bed 1 so that the stitch transfer device A can be freely moved on the needle bed 1. If the switch plate 96 is moved from its extreme right to its extreme left position, then the feed gear 85 is engaged with the rack 89 so that the device A is again brought under control of the feed mechanism 15.

With the stitch transfer device of the above-described construction, stitches on the latch needles 4 on the front needle bed 3 may be transferred onto the corresponding latch needles 2 on the rear needle bed 1 in the manner as described below.

In preparation for the operation of the stitch transfer device A, stitches 58 on the front bed needles 4 are brought to positions in which they are carried on the stems, behind the open latches, of the needles 4 (see FIG. 10), for example, by manually raising the needles 4 to a position in which the hooks 93 are in positions aligned with the upper ends of the rear bed sinker elements 56 (FIG. 10). The needles 2 in the rear needle bed 1 are then brought to intermediate positions for admission of the butts 59 thereof into the cam track 65 while stitches 94 are held in the respective hooks 68 of the rear bed needles 2.

After these preparatory steps, the stitch transfer device A (with its switch plate 96 set to the rightward position) is mounted in operative position over the rear needle bed on the right side of the knitting needles 2 that carry the knitted web. The stitch transfer device A is then moved leftward to a point close to the needles 2 in the intermediate position and the switch plate 96 is then moved or set to its leftward position to cause the feed gear 85 to engage the rack 89 on the needle bed 1 as described above. A conventional detent member 100, which engages the teeth of the feed gear 85, thereby establishes the initial position of the stitch transfer device A. The handle 21 is then manually operated in a clockwise direction through an appropriate number of revolutions to cause the cam block 10*a* and the associated cams to effect the transfer of stitches from the front bed needles 3 to the rear bed needles 1 with one revolution of the cam block 10*a* taking place for each stitch transferred.

When the cam block 10*a* is in its initial position, that is, with the handle 21 in the most forward position as shown in FIGS. 1 and 2, the transfer element 11 is in its upper forward position spaced remotely from the sinker elements 56, 57 of both needle beds 1, 3 from the positioning member 12 in its rearward inoperative position clear of the sinker elements 56 of the rear needle bed 1, and from the needle restraining member 13 in its upper inoperative position clear of any knitting needle 2, as shown in FIG. 10. The needle advancing cam 60 is in its rearward position as shown in FIG. 3.

During each clockwise rotation (as viewed in FIG. 1) of the block cam 10*a*, the carrier 5 is first displaced by one needle space into a position in a plane which includes the loop transfer element 11 on the device A, a particular front bed needle 4 having thereon a stitch to be transferred during the respective, already initiated rotation of the block cam 10*a*, and which also includes a particular rear bed needle 2 which is to receive the stitch from the particular front bed needle 2, so as to allow transfer of the stitch to be effected within the plane. In the meantime, the particular needle 2 which was moved forward from its intermediate position by the advancing cam portion 65*a* of the track cam 65 has now moved to a new position in which its butt 59 is in front of the needle advancing cam 60 and in which its hook 68 is positioned immediately behind the particular front bed needle 4 (FIG. 10). Subsequently, the positioning member 12 is displaced to its forward operative position to engage its projections 71 and 71*a* between the sinker elements 56 (as indicated in broken lines in FIG. 10) to fix the carrier 5 relative to the needle beds 1, 3. Simultaneously, the needle restraining member 13 is pivoted into its operative position to receive the stem of the particular needle 2 in the recess 74*a* between the guide fingers 74 thereof (indicated in phantom in FIG. 10), thereby preventing inadvertent lateral movement of the stem of the needle 2.

Next, the stitch transfer element 11 is displaced laterally rearwardly from its upper forward position to the upper rearward position to receive the end of the hook 93 of the particular needle 4 in its recess defined by the guide portions 33 of the springs 26 and the lower end face of the shank 11*a* thereof (as indicated by broken line in FIG. 10), and then displaced axially downward to the lower rearward position whereupon the particular needle 4 is pushed down axially into the needle bed 2 by the lower end of the shank 11*a* of the transfer element 11. Upon this downward movement of the needle 4, its stitch 58 is displaced from the needle 4 onto the stitch transfer element 11 under the guidance of the guide portions 33 and, in due course, it is brought into engagement with the lower edge of the rear projection 28 of the stitch holding member 25 to cam the stitch holding member 25 away from the shank 11*a* (as indicated in broken lines in FIG. 11) against the action of the leaf spring 31 to thereby admit the stitch 58 into the space between the stitch holding member 25 and the shank 11*a*. As soon as the stitch 58 is received in this space, the stitch holding member 25 is returned to its normal, closed, stitch holding position (as indicated by solid lines in FIG. 11) to allow the stitch 58 to be thereafter held on the rear projection 28 of the stitch holding member 25.

The stitch transfer element 11 is then displaced axially upwards from the rear lower position to its rear middle position (FIG. 12). During the upward movement of the element 11, the flexibility of the guide portions 33 of the springs 26 permits the guide portions 33 to be cammed away from each other by the hooked end of the particular needle 4, which is held in position due to the friction between that needle 4 and the needle bed 2, so that the particular needle 4 is left in the lowered position in the needle bed 2. The stitch 58 is now received on the rear projection 28 of the stitch holding member 25 and assumes a slightly laterally expanded state in front of the guide portions 33, now prepared for subsequent projection there-through of the particular rear bed needle 2.

The needle advancing member 14 is then operated to advance the particular needle 2, whereupon the stitch 94 is displaced rearwardly to be supported on a base portion of the latch 95 while the hook 68 of the needle 2 is passed through the recess between the guide portions 33 of the stitch transfer element 11 and then through the stitch 58 received by the stitch holding member 25. The needle hook 68 is then abutted against the needle guide surface 23 of the stitch transfer element 11 to pivotally displace the member 25 into the stitch releasing position (as indicated by full line in FIG. 12) whereby the stitch 58 is dislodged from the projection 28 and is now received by the projected particular rear bed needle 2 between the hook 68 and opened latch 95 thereof (as indicated in solid lines in FIG. 12).

Subsequently, the stitch transfer element 11 is displaced axially upwardly into its rearward upper position (FIG. 13) whereupon the guide portions 33 thereof are again cammed away by the particular rear bed needle 2 to permit the element 11 to be released from the particular needle 2, and element 11 is then moved laterally forwards to return to its upper forward position. In the meantime, the needle advancing member 14, positioning member 12 and needle restraining member 13 are also returned to their respective initial positions. Thus, by one complete rotation of the cam block 10*a* of the actuator mechanism 10, a sequence of operations for transferring a stitch from a front bed needle 4 to an opposing rear bed needle 2 is completed. The particular needle 2 now having the original stitch 94 and transferred stitch 58 thereon is later retracted to an intermediate position by the retracting cam surface 67 of the track cam 65 as the carrier 5 is fed in the leftward direction as viewed in FIG. 1.

Thus, by continuously operating the actuator mechanism 10 through the handle 21, the stitches 58 on the needles 4 of the front needle bed 3 are successively transferred onto the corresponding needles 2 of the rear needle bed 1.

In a case where the stitches are to be transferred in a contrary fashion, namely, from the needles 2 of the rear needle bed 1 to the corresponding needles 4 of the front needle bed 3, operations are substantially the same as those described above except that preparatory positioning is relatively reversed between the needles 2 and 4 and that the carrier 5 is mounted an operated on the front needle bed 3. Therefore, description of the reverse stitch transferring operations is omitted herein to avoid repetition.

Figure 14:
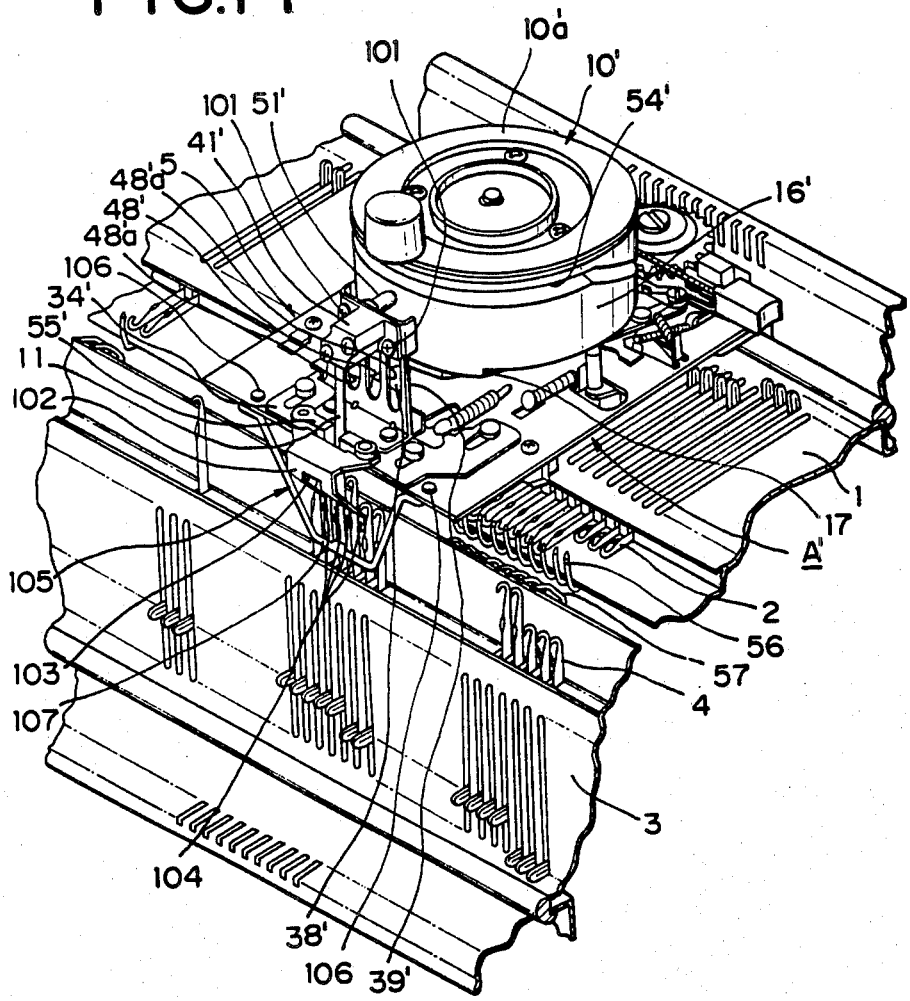
FIG. 14 is a view similar to FIG. 1 but depicting a second embodiment of the invention.

In FIG. 14 there is illustrated another stitch transfer device A′ embodying the present invention. The improved stitch transfer device A′, as compared with transfer device A, incorporates some modifications of the means for actuating the stitch transfer element 11 and some additional elements for protection of, and for ensuring the desired motion of, the stitch transfer element 11. For simplification, description of components common to the above described first embodiment will be omitted herein. In FIG. 14 parts corresponding to parts in FIGS. 1 to 13 have the same reference but with a prime mark′.

In the embodiment of FIG. 14, the transfer element 11 is mounted on a holder 41′ to which a spring plate (not shown) is attached by means of two fastening screws 101 which extend through vertically elongated slots 48*a′* formed in an upright support plate 39′ so that the holder 41′ can slide on and relative to the support plate 39′. The holder 41′ further has a pin 51′ mounted thereon which extends rearwardly through another vertically elongated slot 48′ formed in the support plate 39′. In this embodiment, the pin 51′ is designed as a cam follower cooperating with a modified cam groove 54′ of an actuator cam 16′, eliminating the necessity for a link mechanism such as the mechanism including the coupled levers 45 and 52 of the first embodiment.

The upright support plate 39′ is formed separately from and mounted on a slide plate 34′ while the support plate 34 in the first embodiment is formed integrally with the slide plate 34. The slide plate 34′ is slidably mounted on the carrier 5 in a similar manner to the arrangement in the first embodiment and is biased rearwardly by means of two springs 78 (only one of which is shown). The slide plate 34′ has a rearwardly extending projection 38′ formed at the top of a rear upward extension thereof. The projection 38′ is a cam follower of an actuator cam 17 of a modified cam block 10*a*′. The cam block 10*a*′ of the actuator mechanism 10′ of the stitch transfer device A′ also includes similar actuator cams for actuation of the positioning member, needle restraining member, needle advancing member and feed mechanism, though not shown in FIG. 14. Also in this embodiment, these actuator cams including the cam 16′ of the cam block 10′ and their associated cam follower mechanisms operate in substantially the same timed relationship to one another as in the stitch transfer device A of the first embodiment to perform the stitch transfer operations as described above.

The stitch transfer device A′ is additionally provided with a further restraining member 102 having an inverted L-shape in a side elevational view and having a horizontal base portion and a vertical portion. The restraining member 102 is mounted via the horizontal portion thereof on forward mid portion of the slide plate 34′. A recess 103 is formed in the vertical portion of the restraining member 102 in opposition to the stitch transfer element 11 so as to permit pivotal motion of the stitch holding member 25 in its plane. A pair of legs of the restraining member 102, which legs bound the recess 103, are bifurcated at their lower ends to provide two pairs of fingers 104 in the same spaced relationship as the sinker elements 56 and 57 of the needle beds 1 and 3.

In the initial forward upper position of the stitch transfer element 11, the fingers 104 of the restraining member 102 are in a position forward of and spaced from the sinker elements 57 of the front needle bed 3. Since the restraining member 102 is secured to the slide plate 34′, it will be moved rearwardly upon rearward movement of the stitch transfer element 11 on the slide plate 34′. The restraining member 102 is arranged so that, where the needle bed 1 and 3 are regularly positioned relative to each other with their needles 2 and 4 being in head to head alignment to permit stitch transfer therebetween, the fingers 104 thereof may be permitted to enter between the adjacent front bed sinker elements 57 whereas, where the needle beds 1 and 3 are in a relatively irregular position, the fingers 104 will abut against the forward ends of the adjacent sinker elements 57 during rearward movement of the restraining member 102. Thus, in the former case, the operation of the stitch transfer device A′ may be continued in a regular manner whereas, in the latter case, rearward movement of the slide plate 34′ will be blocked by the restraining member 102 abutting against the sinker elements 57. Consequently, in the latter case, the slide plate 34′ will be blocked to an intermediate position in which the cam follower pin 51′ is spaced from the high portion of the associated actuator cam 16′ instead of running thereinto and hence the stitch transfer element 11 will be retained in its upper position without making axial downward movement even if the actuator cam 16′ is continuedly rotated in the predetermined direction, thereby protecting the stitch transfer element 11′ from accidental damage due to possible interference with a machine component such as a sinker element 57. Thus, according to the modified stitch transfer device A′, stitch transfer operations are not effected when the machine is in an irregular position.

The stitch transfer device A′ is further provided with a protector member 105 for the stitch transfer element 11, which protector member 105 consists of a metal wire bent into a trapezoidal shape. The protector member 105 has its opposite ends secured to the underside of the carrier 5 at the front thereof, by means of screws 106 and extends downwardly therefrom and is so positioned in relation to the stitch transfer element 11 that its lower horizontal portion 107 remains located beneath the guide portion 33 of the stitch transfer element 11 in the lower most position.

With the foregoing arrangement, when the stitch transfer device A′ is removed from the needle bed 1 and placed on a knitting table or the like, the lower horizontal portion 107 of the protector member 105 may lie on the table top and hence prevents the stitch transfer element 11 from being damaged by striking against the knitting table.

Although particular embodiments have been shown and described, various modifications may be made which fall within the true spirit and scope of the invention as set forth in the appended claims.

We claim:

1. A loop transfer device for transferring loops from knitting needles in a first needle bed to knitting needles in a second needle bed of a V-bed knitting machine, said first and second needle beds being disposed such that the needles in said first needle bed are opposed to the needles in said second needle bed, said needles having each a latch pivotable to open and close a hook thereof and being mounted in the associated needle bed for back and forth movement in a side by side relationship to each other, said loop transfer device comprising:

a carrier slidably mounted on said second needle bed;

a loop transfer element for transferring a loop from a first particular needle in said first needle bed to a second particular needle in said second needle bed;

first means for mounting said transfer element for movement in an axial direction in parallel relationship with a first plane of said needles in said first needle bed;

second means for mounting said element for movement in a lateral direction;

means for advancing the second needle in said second needle bed;

means for feeding said carrier one needle space on said second needle bed; and a single cyclically operable actuator mechanism for sequentially actuating said first and second means as well as said means for advancing and said means for feeding;

whereby said carrier is first fed one needle space on said second needle bed, said element is then moved from its initial position in a lateral direction into a position in said plane and into engagement with the first needle and then in an axial direction to push the first needle into said second needle bed whereupon the loop on the first needle is transferred onto said element and again in the opposite axial direction out of engagement with the first needle, then the corresponding second needle in said second needle bed is advanced to project its hook through the loop on said element to receive the loop from said element, and finally said element is moved in the opposite lateral direction to its initial position, thereby completing transfer of the loop from the first to the second needle.

2. A loop transfer device as claimed in claim 1, further comprising means operatively coupled to said actuator mechanism for preventing undesirable lateral movement of the first needle during advancing movement thereof to ensure projection of its hook through the loop on said loop transfer element.

3. A loop transfer device as claimed in claim 2, wherein said means for preventing includes a rockable member having at a free end thereof a pair of fingers defining therebetween a recess for receiving the stem of the first needle therein, said rockable member being rockable from an initial position clear of the first needle to an operative position engaged with the first needle.

4. A loop transfer device as claimed in claim 1, further comprising means operatively coupled to said actuator mechanism for locking said carrier from moving on and relative to said second needle bed during advancing movement of the first needle to ensure projection of the second needle through the loop on said loop transfer element.

5. A loop transfer device as claimed in claim 4, wherein said means for locking includes a member having a plurality of teeth formed thereon and adapted to engage between adjacent sinker elements fixedly mounted along said second needle bed to thereby lock said carrier relative to said second needle bed.

6. A loop transfer device as claimed in claim 1, wherein said second means includes a plate member having an upright wall thereon and mounted for sliding movement on said carrier in a direction parallel to the direction of movement of the second needle in said second needle bed, and first means includes a holder having said loop transfer element fixed thereon and mounted for sliding movement on said upright wall in a direction parallel to said first plane.

7. A loop transfer device as claimed in claim 1, further comprising means disposed adjacent opposite sides of said loop transfer element for preventing inadvertent lateral movement of said element.

8. A loop transfer needle for use with a loop transfer device for transferring loops from knitting needles in a first needle bed to knitting needles in a second needle bed of a V-bed knitting machine, comprising a stem having one end connected to said loop transfer device, and a pair of spring fingers extending along opposite sides of said stem, each of said spring fingers having one end secured to an intermediate portion of said stem, the other ends of said spring fingers extending beyond the other end of said stem and being bent and originally biased towards each other to resiliently engage their extremities with each other, said the other ends of said spring fingers and the extremity of said the other end of said stem cooperatively defining an eye which can receive therein the hook of a first particular needle in said first needle bed when the first needle is in position in a first plane including therein said needles in said first needle bed and through which a second particular needle in said second needle bed can project in a direction perpendicular to said first plane.

9. A loop transfer needle as claimed in claim 8, wherein said stem has a groove formed in said extremity of said the other end thereof, the grooved extremity having a substantially inverted V-shaped cross section as taken along a second plane including said spring fingers therein, said groove extending obliquely relative to said stem and to said second plane so as to cammingly guide the hook of the second needle when the second needle is projected through said eye.

10. A loop transfer needle as claimed in claim 8, further comprising a loop holding member mounted at one end thereof on said stem for pivotal motion in a plane perpendicular to said second plane, said holding member extending from said stem and having at the other end thereof a projection which is directed towards said stem such that a spacing through which a loop can extend is defined by and between said stem and said holding member when said holding member is in a normal position with its projection abutted against said stem, said holding member being capable of holding a loop on said projection thereof.

11. A loop transfer device as claimed in claim 10, wherein said loop holding member has at said the other end thereof an extension which is engaged by the hook of the second needle during projection of the second needle through said eye to pivot said holding member away from said stem thereby to permit the loop to be let off said projection of said holding member into the hook of the second needle.

12. A loop transfer device as claimed in claim 10, wherein the outer edge of said projection of said loop holding member is inclined such that, when a loop approaches and then engages with said outer edge of said projection, said holding member is cammed to pivot away from said stem thereby to permit the loop to be received in said spacing.

13. A loop transfer device as claimed in claim 12, further comprising a spring member for urging said holding member into said normal position.

* * * * *